US012011108B1

(12) United States Patent
Brown

(10) Patent No.: US 12,011,108 B1
(45) Date of Patent: Jun. 18, 2024

(54) ADJUSTABLE HANGER

(71) Applicant: Marcus-Alan Asher Brown, Los Angeles, CA (US)

(72) Inventor: Marcus-Alan Asher Brown, Los Angeles, CA (US)

( * ) Notice: Subject to any disclaimer, the term of this patent is extended or adjusted under 35 U.S.C. 154(b) by 50 days.

(21) Appl. No.: 17/988,241

(22) Filed: Nov. 16, 2022

Related U.S. Application Data

(60) Provisional application No. 63/280,407, filed on Nov. 17, 2021.

(51) Int. Cl.
*A47G 25/40* (2006.01)

(52) U.S. Cl.
CPC ..... *A47G 25/4053* (2013.01)

(58) Field of Classification Search
CPC .... A47G 25/14; A47G 25/1414; A47G 25/40; A47G 25/4046; A47G 25/4053; A47G 25/4069
See application file for complete search history.

(56) References Cited

U.S. PATENT DOCUMENTS 1,086,863 A * 2/1914 Slye ..... A47G 25/4069 223/89
1,111,147 A 9/1914 Fogde
1,955,995 A * 4/1934 Wood ..... A47G 25/40 223/89
2,107,873 A * 2/1938 Okun ..... A47G 25/40 223/94
2,507,906 A * 5/1950 Joseph ..... A47G 25/4076 223/89
2,509,723 A * 5/1950 Chezum ..... D06F 59/02 223/69
3,464,604 A * 9/1969 Chezum ..... D06F 59/02 223/69
5,044,535 A 9/1991 Hunt
5,456,391 A * 10/1995 Chang ..... A47G 25/443 223/89
5,511,701 A * 4/1996 Lam ..... A47G 25/443 223/89

(Continued)

FOREIGN PATENT DOCUMENTS

CN 104352146 A 2/2015
CN 204292839 A 4/2015

*Primary Examiner* — Shaun R Hurley
(74) *Attorney, Agent, or Firm* — Bold IP, PLLC

(57) ABSTRACT

An adjustable hanger is described with an adjustment dial and internal assembly that enables the adjustable hanger to retract and expand to varying lengths. The adjustable hanger can be adjusted manually using an adjustment dial that a user lifts up to rotate in a clockwise or counterclockwise direction to adjust the length of the adjustable hanger as desired. The adjustable hanger can include pre-determined sizes or lengths that range from a "0" size whereby the hanger is fully retracted and useful for storage or transport. Additionally, the hanger can include pre-determined positions for a small, medium, large, and x-large or other sizes for an article of clothing or another item. The hanger includes a faceplate, baseplate, adjustable dial, control pillar, control link, and a first movable arm and a second movable arm made up of connecting rods that can rotationally engage with each other to extend and retract.

20 Claims, 17 Drawing Sheets

(56) References Cited

U.S. PATENT DOCUMENTS

| | | | | |
|---|---|---|---|---|
| 5,664,710 | A * | 9/1997 | Lam | A47G 25/1407 223/89 |
| 7,077,300 | B1 | 7/2006 | Petro | |
| 7,641,084 | B1 * | 1/2010 | Alcaraz | A47G 25/443 223/89 |
| 8,459,514 | B2 | 6/2013 | Lagzdins | |
| 9,316,350 | B2 | 4/2016 | Matsuoka | |

* cited by examiner

ADJUSTABLE HANGER

CROSS-REFERENCE TO RELATED APPLICATIONS

This application is a non-provisional application which claims priority to U.S. Provisional Patent Application No. 63/280,407 filed on Nov. 17, 2021, which is incorporated by reference in its entirety.

FIELD OF THE DISCLOSURE

The invention generally pertains to an adjustable hanger and, more specifically, to an adjustable hanger that can accommodate clothing of varying sizes, can collapse for easy storage, and is designed to display a selected hanger size.

BACKGROUND

Maintaining and storing clothing often requires using clothes hangers. Additionally, clothes on hangers should have hangers of the appropriate size. Unfortunately, people often use hangers of a standard size that is not the optimum size for hanging all pieces of clothing. Clothing hung on incorrectly sized hangers can stretch leaving marks that are difficult or even impossible to remove. Further, when multiple sizes of clothing are hung side by side, determining the respective clothing sizes requires manual inspection. Hangers can be produced in a variety of sizes to accommodate differently sized clothes. Hanger size can be indicated at or near the base of the hook. Thus, if a person has differently sized clothes and wants to ensure the differently sized clothes hang appropriately, differently sized hangers are typically needed.

SUMMARY

An adjustable hanger is presented according to one or more non-limiting embodiments comprising a hanger hook connected to an adjustment user dial assembly. In a non-limiting embodiment, the adjustment user dial assembly may include a faceplate having a body with a curved member connected to a bottom edge with a gap between the bottom edge and the curved member, and a faceplate central opening formed connected to the bottom edge, and further comprise first post and a second post extending from a bottom surface of the faceplate. Further, the adjustment user dial assembly may comprise an adjustment user dial having a handle sticking up over a top surface of a platform of the adjustment user dial and a peg protruding from a bottom surface of the platform of the adjustment user dial, wherein the bottom surface of the adjustment user dial further comprises a first opening, and wherein a pointer is coupled to a front side of the platform of the adjustment user dial. The adjustment user dial assembly may comprise a control pillar comprising a top element having a cross-sectional shape corresponding to a shape of the first opening of the adjustment user dial and a bottom surface having a bottom element, whereby the top element fits into the first opening of the adjustment user dial.

The adjustment user dial assembly may further comprise a control link, whereby the control link is an elongated rod having a hole configured to receive the peg of the adjustment user dial, wherein the control link further comprises a central opening, wherein the hole is positioned next to the central opening of the control link, wherein the bottom element of the control pillar fits within the central opening of the control link and has the same cross-sectional shape of the central opening of the control pillar. Further, the adjustment user dial assembly may comprise a baseplate, wherein the adjustment user dial, the control pillar, and the control link are housed between the faceplate and the baseplate of the adjustment dial assembly, wherein the baseplate has a generally arch-shaped body and further comprises two post openings on each end of the base plate that are adapted to receive the first post and the second post of the faceplate. Further, the baseplate may further comprise a platform formed between the two post openings of the baseplate, wherein the platform comprises a set of peg holes configured to receive the peg of the adjustment user dial, wherein the set of peg holes correspond to pre-determined sizes labeled on a front surface of the faceplate, wherein moving the handle of the adjustment user dial causes the peg to rotate to one of the peg holes of the set of peg holes.

The adjustable hanger may further comprise a first moveable arm comprising a first set of connecting members that are interconnected, linkable, and movable about pivot points built into each connecting member of the first set of connecting members, wherein the adjustment user dial assembly is adapted to cause the coordinated expansion and retraction of the first moveable arm to a left direction of the adjustment user dial assembly. Further, the adjustable hanger may further comprise a second moveable arm comprising a second set of connecting members that are interconnected, linkable, and movable about pivot points built into each connecting member of the second set of connecting members, wherein the adjustment user dial assembly is adapted to cause the coordinated expansion and retraction of the second moveable arm to a right direction of the adjustment user dial assembly. Further, the first moveable arm and the second moveable arm are adapted to retract and expand over a range of pre-determined widths that correspond to the pre-determined sizes, wherein the handle of the adjustment user dial is adapted to be lifted and rotated in a clockwise or counter clock wise direction to position the peg of the adjustment user dial in a peg hole of the set of peg holes that corresponds to a desired size of the pre-determined sizes, thereby causing the first moveable arm and the second moveable arm to engage in the coordinated expansion or retraction of the first moveable arm and the second moveable arm to a pre-determined width that corresponds to the desired size.

Other aspects and advantages of the invention will be apparent from the following description and the appended claims.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Figure 1A:
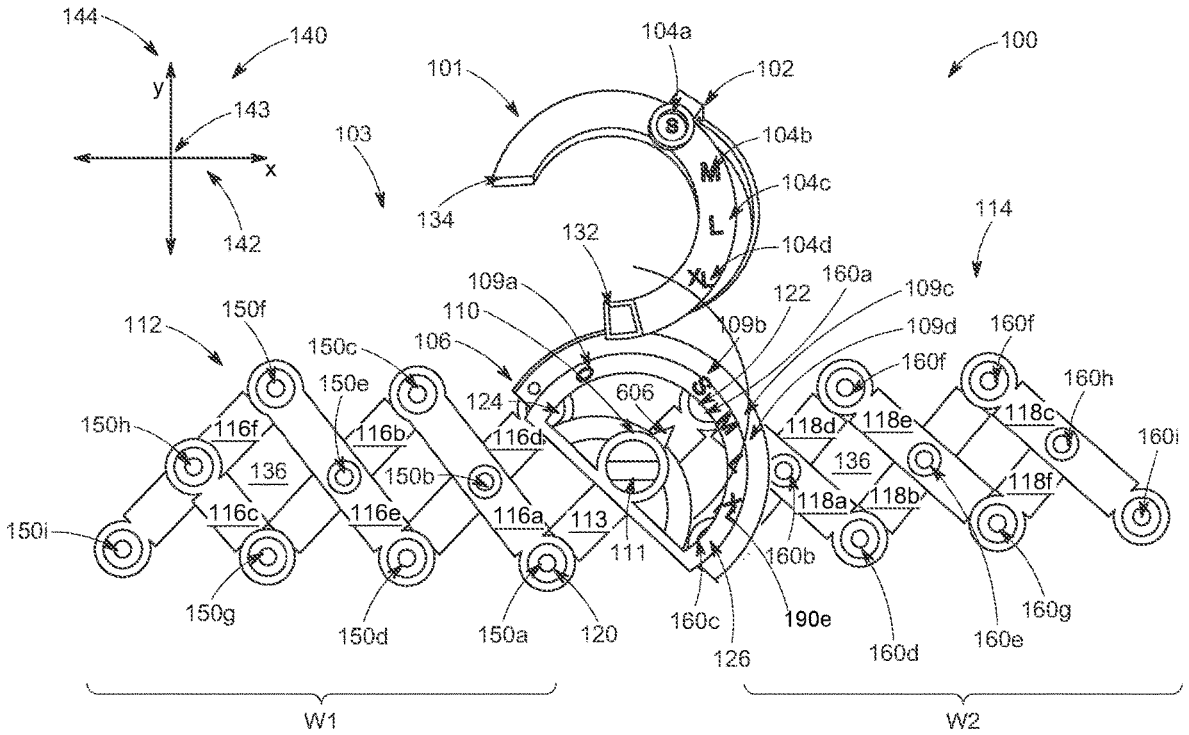
FIG. 1A is a pictorial illustration of a front side of an assembled adjustable hanger.

The present disclosure recognizes the unsolved need for an easy to use, improved, and more effective means of hanging clothing or other articles due to the lack of variable sizing clothing hangers. The present disclosure discloses an adjustable hanger that can be used to hang a variety of differently sized clothing articles or other non-clothing articles of varying sizes. The present disclosure provides a way to adjust to the appropriate and corresponding size for the clothes that the hanger hangs, visually demonstrate the adjusted size, and collapse for convenient storage.

FIGS. 1A-14 display an adjustable clothes hanger 100 that can be manually adjusted by a user to expand and retract the first moveable arm 112 and the second moveable arm 114 of the adjustable clothes hanger 100 in a lateral direction away from or towards an adjustment user dial assembly 106, in order for the adjustable clothes hanger 100 to be customized to vary from maximum retraction to maximum extension and accommodate various sizes of clothes that are to be hung on the adjustable clothes hanger 100. In a non-limiting embodiment, the adjustable clothes hanger 100 has a hook 101 that can be hooked over a hanger bar or any other element to display an item of clothing hung on the adjustable clothes hanger 100. The adjustable clothes hanger 100 may be used to hang clothes in a known manner in that the hook portion 101 of the adjustable clothes hanger 100 may be inserted through a neck hole of an article of clothing and hang on the first moveable arm 112 and the second moveable arm 114 of the hanger 100. Alternatively, or additionally, a left and right side of an open piece of article of clothing that does not have a dedicated neck hole may simply be hung around the first moveable arm 112 to the left of the hook portion 101 and around the second moveable arm 114 to the right of the hook portion 101. Further, non-clothing articles, such as scarves, jewelry, belts, or accessories or items may be hung onto the moveable arms 112 and 114 of the adjustable hanger 100 if so desired.

In a non-limiting embodiment, there are several advantages offered by the adjustable clothes hanger 100 as shown in FIGS. 1A-14. For example, the hook portion 101, as shown in FIGS. 1A and 1*n* FIG. 1C, may include sizing indicators/label 104*a*, 104*b*, 104*c*, and 104*d* labeled on a front surface of the hook portion 101. Further, in a non-limiting embodiment, there may be a slider 102 that the user can slide down to the appropriate size indicator/label 104*a*, 104*b*, 104*c*, and 104*d* that corresponds or matches the size label 109*b*, 109*c*, 109*d*, and 109*e* located on the faceplate 108 of the adjustable user dial assembly 106 of the adjustable clothes hanger 100. Having a slider 102 that is capable of sliding up or down along the perimeter of the hook portion 101 to highlight a specific size label 104*a*, 104*b*, 104*c*, and 104*d* may also help a user save time in having to either apply a label around the neck of the hook 101 or somehow indicate what the size is of the item hung on the hanger 100. Many stores utilize existing hangers that either have individual labels that either extend from a top of the hook or can be placed around the neck of the hanger. However, these labels are difficult to find and to fit around the hanger, and a great deal of time is wasted fitting them to the neck of the hook. Accordingly, the alternative offered by adjustable hanger 100 of having sizing labels 104*a*, 104*b*, 104*c*, and 104*d* and a slider 102 with an opening that highlights a selected size label 104*a*, 104*b*, 104*c*, and 104*d* is particularly advantageous. Slider 102 may have other configurations and appearances including in the form of a pointer or triangle that can be slid up or down over the hook portion 101 to indicate a particular size 104*a*-104*d*. Hook portion 101 may be formed in a typical shape of a hanger hook and terminate at 134 having an opening for hanging hook portion 101 as needed on a clothing bar or other location.

Figure 1B:
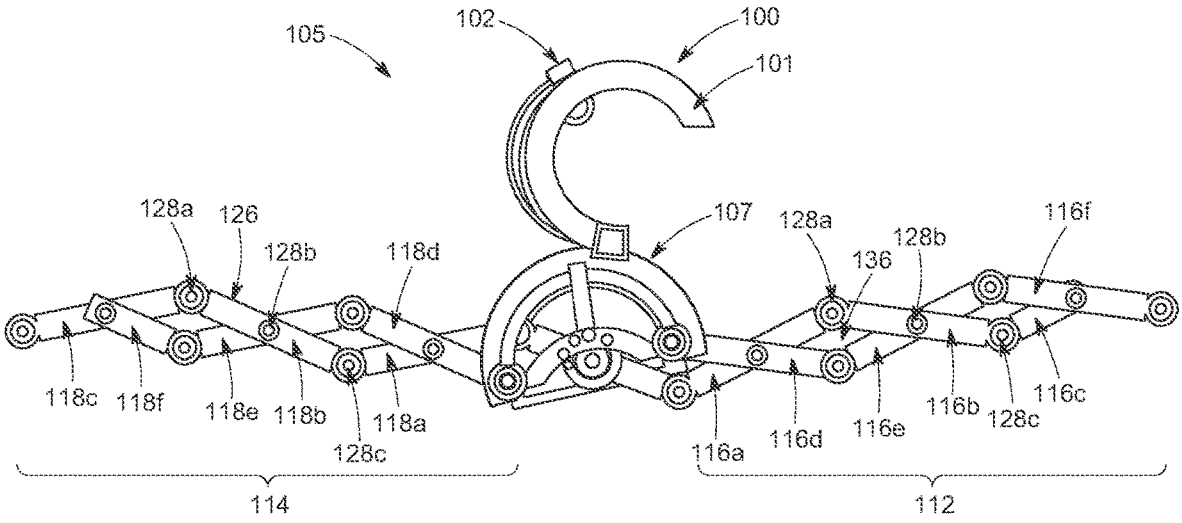
FIG. 1B is a pictorial illustration of a reverse side of the assembled adjustable hanger shown in FIG. 1A shown at maximum expansion.
Figure 1C:
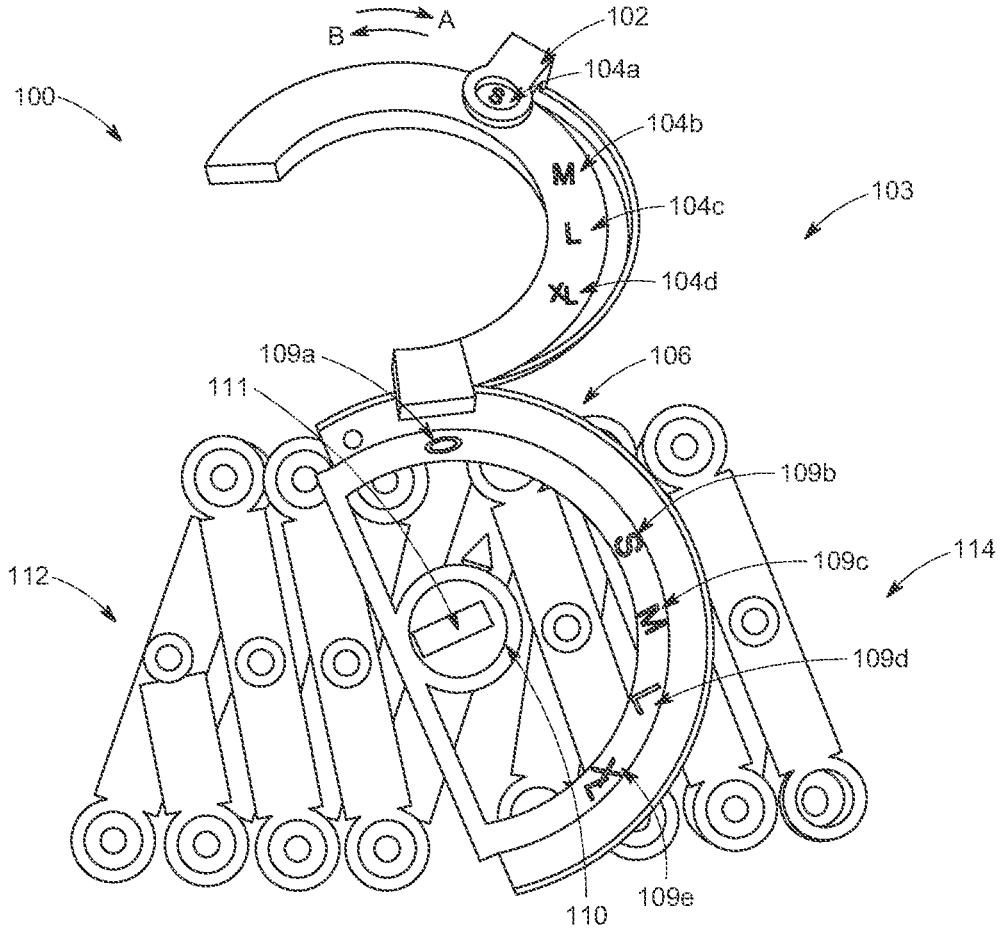
FIG. 1C is a pictorial illustration of a front side of the assembled adjustable hanger shown in FIG. 1A shown at maximum retraction.

Advantageously, in a non-limiting embodiment, the first moveable arm 112 and the second moveable arm 114, as shown in FIGS. 1A-1C, of the adjustable clothes hanger 100 may extend to a maximum position to coordinate with a maximum size (e.g., "XL" 109*e* as shown in FIG. 1A) and then may retract to correspond to a smallest size (e.g., "S" 109*b* as shown in FIG. 1A) and also to a fully retracted state (e.g., "0" 109*a* as shown in FIG. 1A) that may be useful when the adjustable clothes hanger 100 may not necessarily be used to hang clothes and may be a storage position. In a non-limiting embodiment, the adjustable clothes hanger 100 can adjust such that the first moveable arm 112 and the second moveable arm 114 can vary in their respective widths (i.e. W1 and W2 as shown in FIG. 1A) from a maximum retraction point which corresponds to "0" size label 109*a* as shown on the faceplate 108 of the adjustable user dial assembly 106 of the adjustable clothes hanger 100, and then progress gradually over a range of additional sizes. In a non-limiting exemplary embodiment, the adjustable clothes hanger 100 may be able to accommodate at least four separate sizes, including size small "S" 109*b*, size medium "M" 109*c*, size large "L" 109*d*, and size extra-large "XL" 109*e*. It is noted that other sizes may be indicated on the hanger 100 and that the hanger 100 may be formed to accommodate a range of other sizes. Accordingly, alternative sizes may be used instead of 0, S, M, L, and XL as shown in FIG. 1A. Rather, other labels may be visibly displayed or included on the front side 302 of the faceplate 108. It is noted that the adjustable clothes hanger 100 may be manufactured with the same principles of operation as described herein, but having different widths, lengths, and other dimensions in order to be best suited for various types of clothing, including clothes for newborns and babies, children clothing, coats, dresses, and/or clothing. In a non-limiting embodiment, the adjustable hanger 100 may be able to expand in size from at least 8 or 9 inches wide (e.g., for the retracted size 109*a*) to about 14 inches (e.g., for the small size 109*b*) up to about 20 or 22 inches for the extra large 109*e* size. This type of adjustable hanger 100 may be useful for teenage or adult sized clothing. For newborns or children type clothing, the initial range of expansion may be lower and may vary from 8-9 inches up to about 10 or 12 inches for the xlarge size 109*e*. Usefully, the adjustable hanger 100 may be particularly useful for using with a variety of sizes and matching the desired W1 or W2 for the moveable arms 112, 114 to suit the desired width of clothing. Further, in other embodiments, the adjustable hanger 100 may be utilized to hold non-clothing articles, including blankets, table clothes, accessories, or other items.

It is noted that the size indicators 104*a*, 104*b*, 104*c*, and 104*d* and/or the hanger size labels 109*a*, 109*b*, 109*c*, 109*d*, and 109*e* may be engraved into the material of the hook 101 and/or faceplate 108. Alternative methods of including the size indicators 104*a*-104*d* and 109*a*-109*e* may alternatively be used as known in the art other than engraving, including using adhesive labels or other methods. It is also noted that the FIGS. 1A-14 may not be to scale and the placement of the size labels 109*a*-109*e* may not be exact.

Advantageously, the adjustable hanger 100 can be retracted to a maximum position (e.g., when the user dial 110 is turned to the number "0" labeled as 109*a*) for use in particular for storage so that the adjustable hanger 100 does not take up too much room in storage or also when adjustable hanger(s) 100 are in transport. Advantageously, having a single adjustable hanger 100 that can accommodate a variety of sizes of clothing or other non-clothing articles can be a great timesaver and cost saver for stores. A great deal of time is spent among staff looking for the various sizes of the hangers that match the variety of sizes of clothing or other items that can range from small (or extra-small) to extra-large. If a store or other location has access to adjustable hanger 100, then the staff can save a great deal of time by using the adjustable hanger 100 to fit any sized clothing item and quickly be able to adjust the first moveable arm 112 and second moveable arm 114 of the adjustable hanger 100 to fit the article of clothing or other type of item to the desired size.

Figure 6:
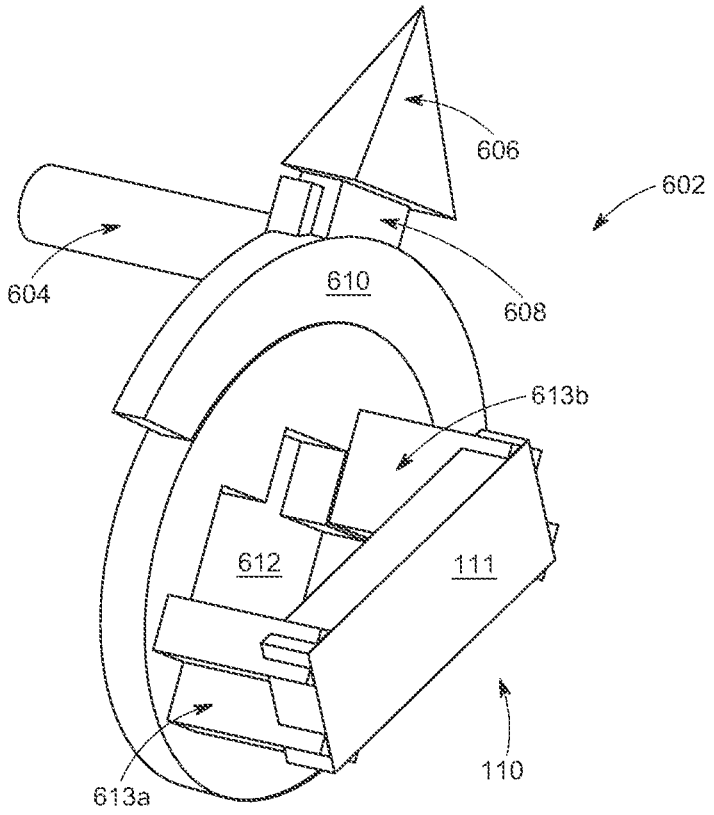
FIG. 6 is a pictorial illustration of a top side of an exemplary adjustment user dial.

As shown in FIG. 1A, in a non-limiting embodiment, an adjustment user dial 110 is part of an adjustment user assembly 106. The adjustment user dial 110 is a knob or dial that a user is able to turn to a desired position or size including, but not limited to, "0" 109*a*, small 109*b*, medium 109*c*, large 109*d*, and extra-large 109*e*. As handle 111 of adjustable user dial 110 is manipulated, sizing pointer 606 as shown in FIG. 6 and in FIG. 12 can indicate the corresponding size from among sizing indicators 109*a*-109*e*.

In a non-limiting embodiment, the user may grab the handle 111 of the adjustment user dial 110 and lift up the handle 111 to turn the handle 111 and the adjustment user dial 110 either in a clockwise direction (in the direction of arrow A as shown in FIG. 1B) or counter clockwise (in the direction of arrow B as shown in FIG. 1B) in order to select the sizing indicators 109*a*-109*e*. Further, there are designated peg holes 516*a*, 516*b*, 516*c*, 516*d*, 516*e* in the baseplate 107 (e.g., as shown in FIGS. 1B and 1*n* FIG. 5) into which a peg 604 of the adjustment user dial 110 can be inserted in order to select either the 0 fully retracted size 109*a* or small 109*b* or medium 109*c* or large 109*d* or x-large 109*e*. Further explanation regarding the operation of adjustment user dial 110 may also be provided with respect to FIGS. 2A-2C and FIGS. 3-14 as well.

FIG. 1A illustrates a front side 103 of the adjustable hanger 100 as assembled. FIG. 1B illustrates a back side 105 of the adjustable hanger 100 as assembled. Further, the extension of the width W1 of the first moveable arm 112 and the extension of the width W2 of the second moveable arm 114 is displayed at its maximum extension (e.g., x-large 109*e*) in FIG. 1B. FIG. 1C displays the fully retracted position in FIG. 1C which corresponds to the size 0 109*a* as shown and displayed on faceplate 108.

Each first moveable arm 112 and the second moveable arm 114 includes a set of linked members 126 that are linked together in a scissor like or accordion like assembly. The term "linked member" as used herein may also be referred to as a "connecting member." In a non-limiting embodiment, the first moveable arm 112 may be made up of a set of first connecting members 116*a*, 116*b*, 116*c*, 116*d*, 116*e*, 116*f*. Further, in a non-limiting embodiment, the second moveable arm 115 may be made up of a set of second connecting members 118*a*, 118*b*, 118*c*, 118*d*, 118*e*, 118*f* as shown in FIGS. 1A and 1*n* FIG. 1B. In a non-limiting embodiment, several connecting member 126 include at least three pivot points 128*a*, 128*b*, 128*c* at which the connecting members 126 can pivot in order for the connecting members.

Figure 11:
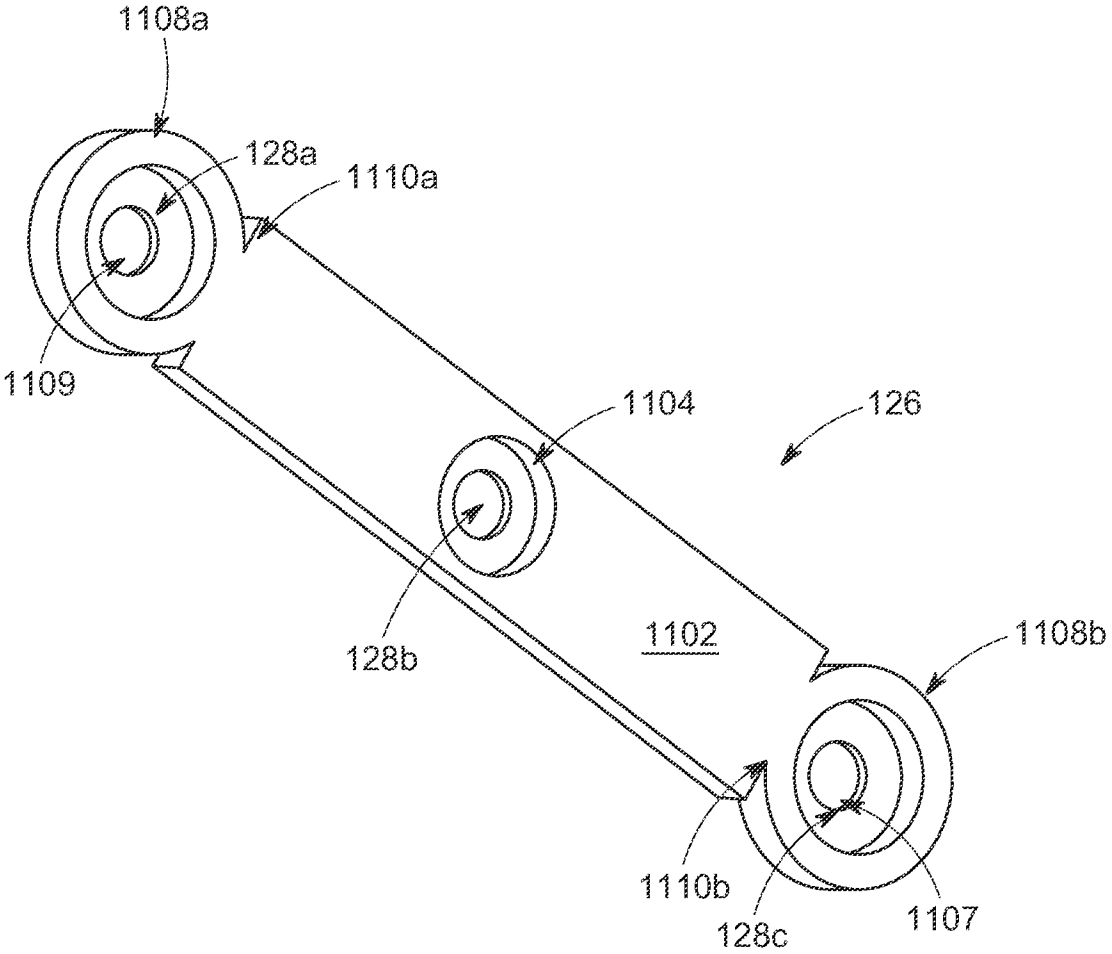
FIG. 11 is a pictorial illustration of a connecting member.

FIG. 11 depicts an exemplary connecting member 126, which may be used to make up connecting links 116*a*-116*f* of the first moveable arm 112 and the connecting links 118*a*-118*f* of the second moveable arm 114. In a non-limiting embodiment, each connecting link 116*a*-116*f*, 118*a*-118*f* includes an elongated member 1102 with a centrally formed central opening 1104. The central opening 1104 may be recessed in the body of the elongated member 1102. On a first end of the elongated member 1102, there may be a first cylinder 1108*a* with a central opening 1109 that is joined at the first end 1110*a* of the elongated member 1102. In a non-limiting embodiment, the elongated member 1102 of the control link 113 (and of the connecting members 126) may be rectangularly shaped. On a second end of the elongated member 1102, there may be a second cylinder 1108*b* with a central opening 1107 that is joined on the opposing end 1110*b* of the elongated member 1102. The first cylinder 1108*a* may represent the first pivot point 128*a*, the central opening 1104 may represent the second pivot point 128*b*, and the second cylinder 1108*b* may represent the third pivot point 128*c*.

Such connecting members 128*a*, 128*b*, and 128*c* as shown in FIG. 1B may be full sized connecting links 126 connecting together. Further, there may be some half-link sizes, which is shown as connecting member 116*c* on the first moveable arm 112 in FIG. 1A and connecting member 118*f* on the second moveable arm 114. Connecting member 116*c* and connecting member 118*f* have only two pivot points 150*h*, 150*g* and 160*h*, 160*g* as shown in FIG. 1A around which another adjacent or connected connecting member 126 can pivot when joined via one or more fasteners.

Figure 2A:
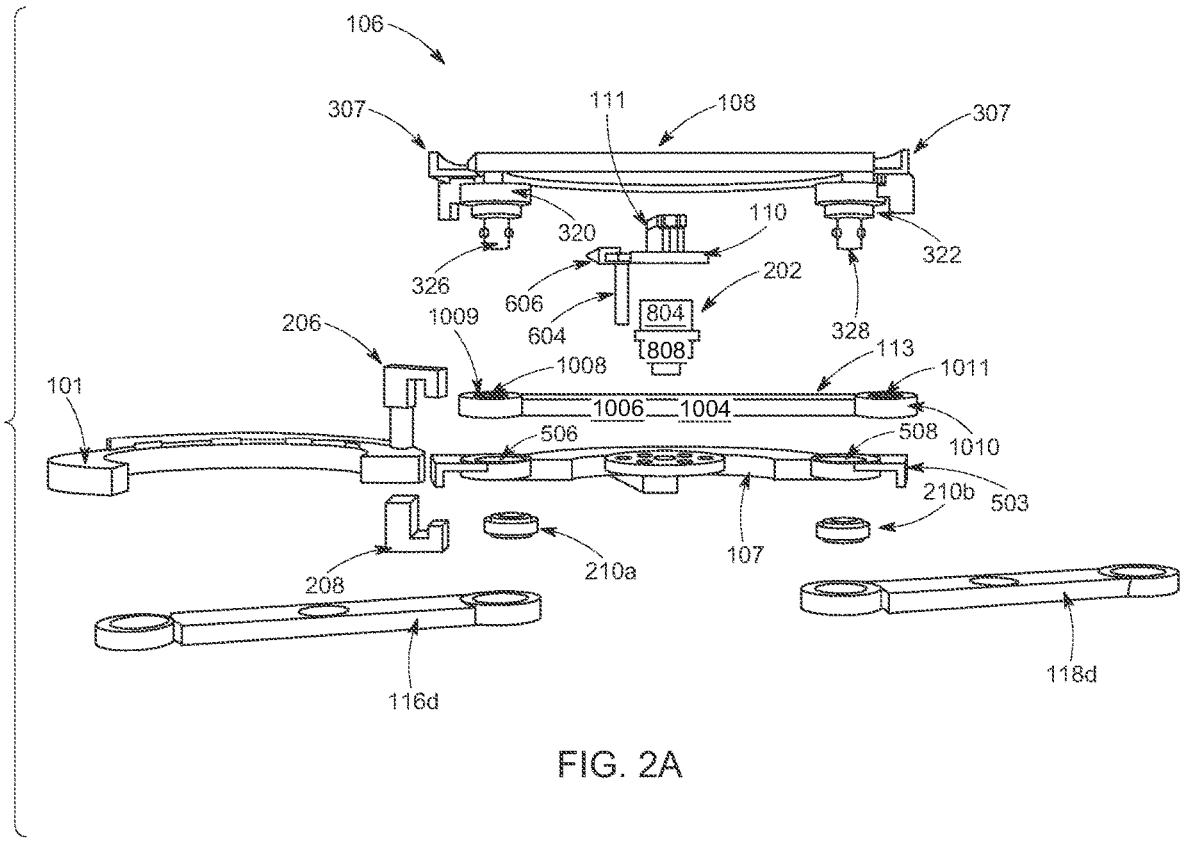
FIG. 2A is an exploded view of the adjustment user dial assembly for the adjustable hanger.
Figure 2B:
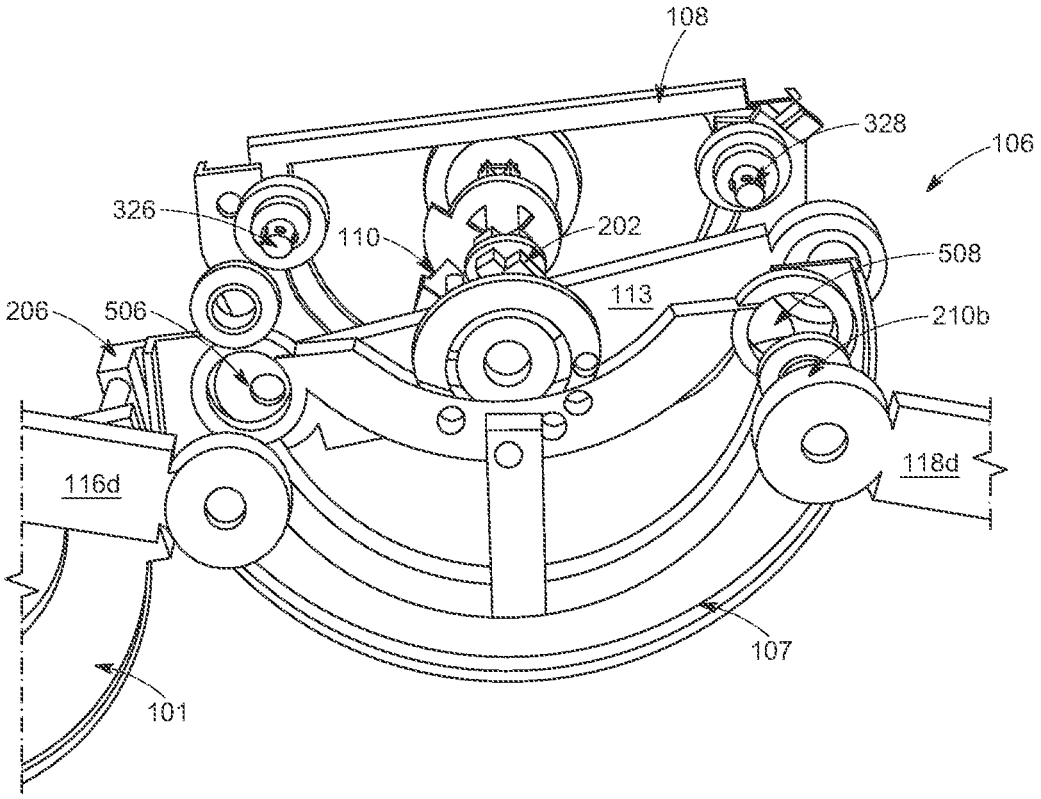
FIG. 2B is an exploded view of the underside of the adjustment user dial assembly for the adjustable hanger.
Figure 2C:
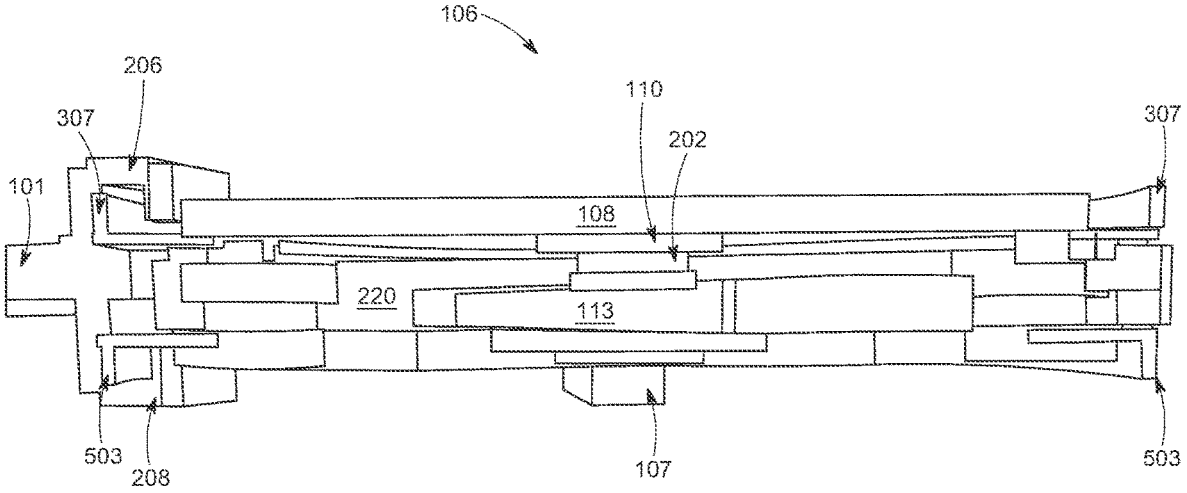
FIG. 2C is an assembled view of the adjustment user dial assembly as shown in FIG. 2A.

In a non-limiting embodiment, housed or sandwiched between the assembled faceplate 108 (e.g., as shown in FIGS. 1A and 1*n* FIGS. 3-4) and the baseplate 107 (as shown in FIGS. 1B and 1*n* FIG. 5) may be a number of components, including an adjustment user dial 110, a control pillar 202 (e.g., as shown in FIGS. 2A-2C), and a control connecting link or member 113. Further, there may be a gap 220, as shown in FIG. 2C, in which the control link 113 has room to rotate up or down within the gap 220 formed between the assembled or connected faceplate 108 and baseplate 107 even when the control link 113 is connected to the starting connecting member 116*a* of the first moveable arm 112 and to the starting connecting member 118*a* of the second moveable arm 114.

Figure 10:
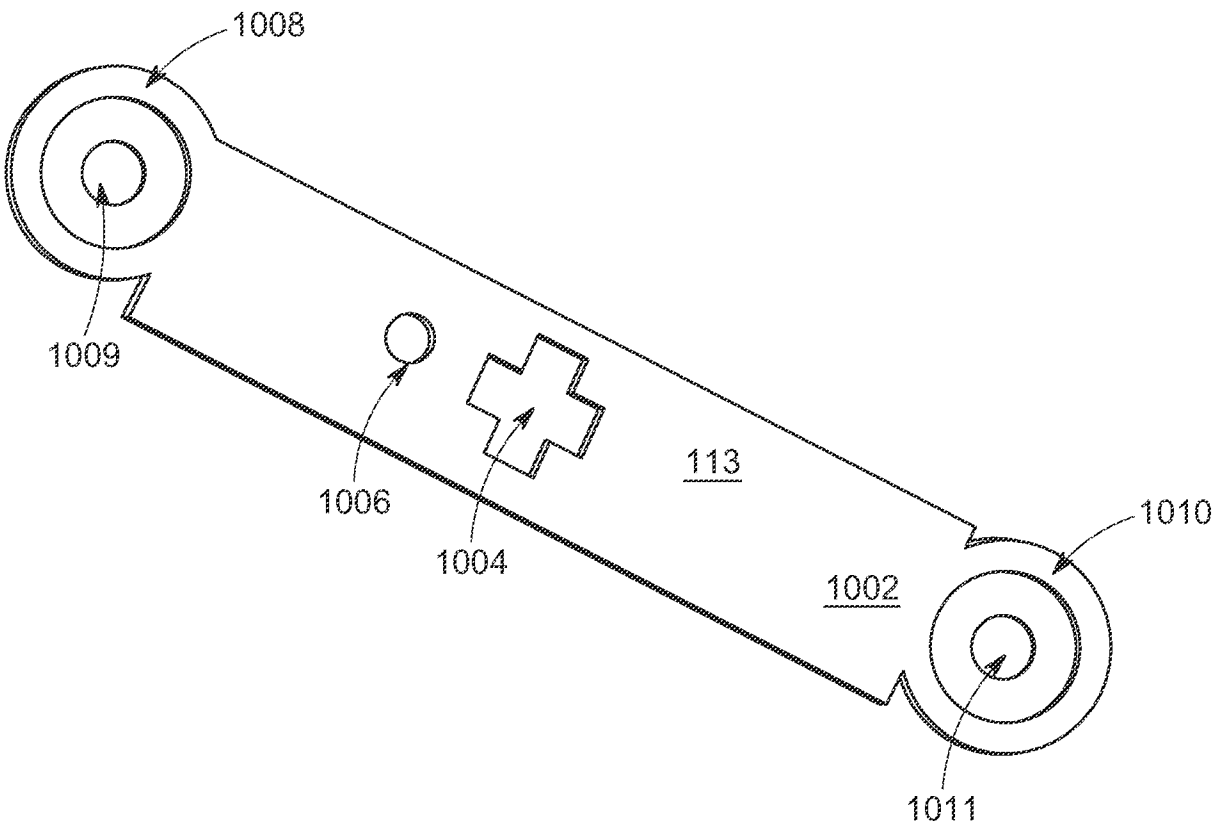
FIG. 10 is a pictorial illustration of a control link.

At point 120, as shown in FIG. 1A, a first end (e.g., 1008 as shown in FIG. 10) of control link 113 may be joined with a first connecting link 116*a* of the first moveable arm 112. At point 122, as shown in FIG. 1B, a second end (e.g., 1010 as shown in FIG. 10) of control link 113 may be joined with a first connecting link 118*a* of the second moveable arm 114. At point 124, a first end of 116*d* of the first moveable arm 112 may be joined or connected to the underside of the baseplate 107 and/or the adjustment user dial assembly 106. Further, at point 126, a first end of 118*d* of the second moveable arm 114 may be joined or connected to an underside of the baseplate 107 (as also shown in FIG. 2A). In this manner, the connection between the control link 113 within the adjustment user dial assembly 106 to connecting member 116*a* of the first moveable arm 112 and also to connecting member 118*a* of the second moveable arm 114 is important for allowing the moveable arms 112 and 114 as made of up of the subsequent linked members 116 and 118 to expand and retract in a coordinated manner. Further, the connection between the linked member 116*d* of the first moveable arm 112 and the linked member 118*d* of the second moveable arm 114 to either lower end or side (e.g., at point 124 and point 126) of the adjustable user dial assembly 106 further enables the subsequent linked members 116 and 118 of the respective arms 112, 114 to expand and retract as needed in a coordinated, synchronous manner. First moveable arm 112 is formed of or made up of a set of interconnected connecting links 116*a*-116*f* in a non-limiting embodiment connected at various hinge points/pivot points as noted below. Further, second moveable arm 114 is formed of or made up of a set of interconnected connecting links 118*a*-118*f* also connected at various hinge points/pivot points as noted below and also shown in FIG. 1A.

In a non-limiting embodiment, as shown in FIG. 1A, control link 113 while attached to other components in the adjustable user dial assembly 106 is connected to connecting link 116*a* at hinge 150*a* (which corresponds to one of the pivot points 128 of the connecting link 116*a*). It is noted that the term "hinge" as used herein may also refer to pivot point and implies that the two connecting links 116*a* are moveable or rotational at the hinge or pivot point. The connecting link 116*a* is connected at hinge 150*b* to connecting link 116*d*, and connecting link 116*a* is also connected at hinge 150*c* to connecting link 116*b*. Connecting link 116*b* is connected at hinge 150*e* to connecting link 116*e* and connecting link 116*b* is also connected at hinge 150*f* to connecting link 116*c*.

Connecting link 116*d* is connected at reference point 124 to the left side/underside of the adjustment user dial assembly 106, and is rotatable at reference point 124. Connecting link 116*d* is connected at 150*b* to connecting link 116*a*. Further, connecting link 116*d* is also connected connecting link 116*e* at hinge 150*d*. Connecting link 116*e* is connected to connecting link 116*b* at hinge 150*e* and also connected to connecting link 116*f* at hinge 150*e*. Connecting link 116*e* is connected to connecting link 116*c* at hinge 150*g*. Additional connecting links 116 may be added to open hinge point 150*i* to add further width to the first moveable arm 112. In this way, a user may add connecting links 126 to the terminal connecting link hinge to add additional width to the adjustable hanger 100 if so desired.

As shown in FIG. 1A, in a non-limiting embodiment, control link 113 is connected to connecting link 118*a* at hinge 160*a* (which corresponds to one of the pivot points 128 of the connecting link 118*a* of the second moveable arm 114). The connecting link 118*a* is also connected at hinge 160*b* to connecting link 118*d*, and connecting link 118*a* is also connected at hinge 160*d* to connecting link 118*b*. At hinge 160*c*, connecting link 118*d* is connected to the underside of adjustment user dial assembly 106, which is also reference point 126 as shown in FIG. 1A.

Connecting link 118*b* is connected at hinge 160*e* to connecting link 118*e* and connecting link 118*b* is also connected at hinge 160*f* to connecting link 118*c*. Additionally, for the second moveable arm 114, connecting link 118*c* is is connected at hinge 160*h* to connecting link 118*f*. Connecting link 118*e* is connected at hinge 160*e* to connecting link 118*b* and connecting link 118*e* is also connected at hinge 160*g* to connecting link 118*f*. Additional connecting links 126 may be added to open hinge point 160*i* to add further width to the second moveable arm 114. Connecting links 116*a*-116*f* and the connecting links 118*a*-118*f* when connected at their respective pivot points/hinges may have gaps 136 as shown in FIGS. 1A and 1*n* FIG. 1B. One or more fasteners may be inserted at each pivot point 128*a* (e.g., opening 1109 of connecting member 126), 128*b* (e.g., opening 1104 of connecting member 126), and 128*c* (e.g., opening 1107 of connecting member 126) for each connecting link 126 in one or more non-limiting embodiments to connect each connecting link 126 to the next connecting link 126, including to connect the connecting links 116*a*-116*f* of the first moveable arm 112 and 118*a*-118*f* of the second moveable arm 114. In a non-limiting embodiment, the fasteners may be in the form of a male cap that is inserted through the openings 1104, 1107, and 1109 of each connecting link/member 126 to form a hinge with another connecting member 126, and may be received by a female cap (e.g., such as caps 210*a*-*b* shown in FIG. 2A) to secure the connecting links 126 to each other. Other types of known fasteners may be used including screws, pegs, or other types of fasteners.

As shown in FIG. 1A, a graph 140 is shown with an x-axis 142 and a y-axis 144. It is noted that the adjustment user dial assembly 106 is configured to rotate over a range of angles around the center point 143 of the graph 140. As shown in FIG. 1A, the adjustment user dial assembly 106 as assembled may be rotated to a right or a left while the hanger hook 101 is vertically oriented, balanced, and remains static or in place with the angle of the hanger hook 101 unaffected while the adjustment user dial assembly 106, including the faceplate 108, rotates either in a clockwise (e.g., as shown by arrow A in FIG. 1C) or counterclockwise (as shown by arrow in FIG. 1C) direction. In a non-limiting embodiment, the range of angles of rotation of the adjustment user dial assembly 106 may range from 0 degrees to 360 degrees if needed, although the range of angle of rotation may be less than 360 degrees as needed.

Further, the connecting links 116*a*-116*f* of the first moveable arm 112 and the connecting links 118*a*-118*f* of the second moveable arm 114 are configured to expand away from the adjustment user dial assembly 106 when the adjustment user dial 110 is lifted and turned in a clockwise direction, which thus causes the first moveable arm 112 and the second moveable arm 114 to expand and lengthen (i.e., W1 of the first moveable arm 112 and W2 of the second moveable arm 114 become lengthened) in a synchronous manner and time. Further, the connecting links 116*a*-116*f* of the first moveable arm 112 and the connecting links 118*a*-118*f* of the second moveable arm 114 are configured to move closer towards the adjustment user dial assembly 106 when the adjustment user dial 110 is lifted and turned in a counterclockwise direction, which thus causes the first movable arm 112 and the second moveable arm 114 to retract and contract (i.e., W1 of the first moveable arm 112 and W2 of the second moveable arm 114 becomes shortened) in a synchronous manner and time.

FIG. 1C shows that when the adjustment user dial 110 is turned to 109*a* or "0" the adjustable hanger 100 is contracted to its maximum and fully retracted position, with the connecting links 116*a*-116*f* of the first movable arm 112 and the connecting links 118*a*-118*f* of the second moveable arm 114 retracted fully. This position as shown in FIG. 1C may be useful when the adjustable hanger 100 is in storage or in transport or even to hang an article of clothing or other item requiring such a retracted size for the first moveable arm 112 and the second moveable arm 114.

FIG. 2A shows an exploded view of the adjustment user dial assembly 106. In a non-limiting embodiment, the adjustment user dial assembly 106 is made up of the faceplate 108 and the baseplate 107 and other components including but not limited to, the adjustment user dial 110, the control pillar 202, and the control link 113. Housed between the faceplate 108 and the baseplate 107 may be the adjustment user dial 110, the control pillar 202, and the control link 113. Further, the hook 101 is connected to the faceplate 108 and to the baseplate 107 via male clamp 206 and female claim 208 as further elaborated on below and shown in FIG. 1C. Further information about the assembly of the adjustment user dial assembly 106 is described below after describing exemplary components and structure for the faceplate 108, the baseplate 107, the adjustment user dial 110, the control pillar 202, and the control link 113.

Figure 3:
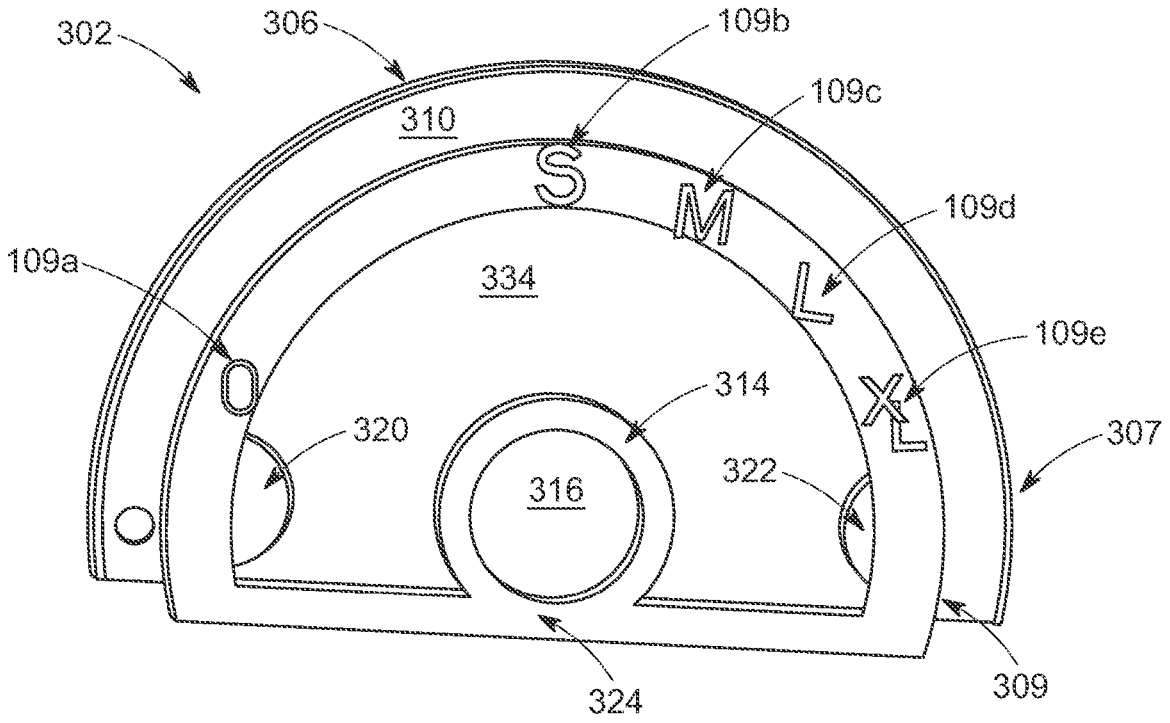
FIG. 3 is a pictorial illustration of a front side of an exemplary faceplate for the adjustment user dial assembly.
Figure 4:
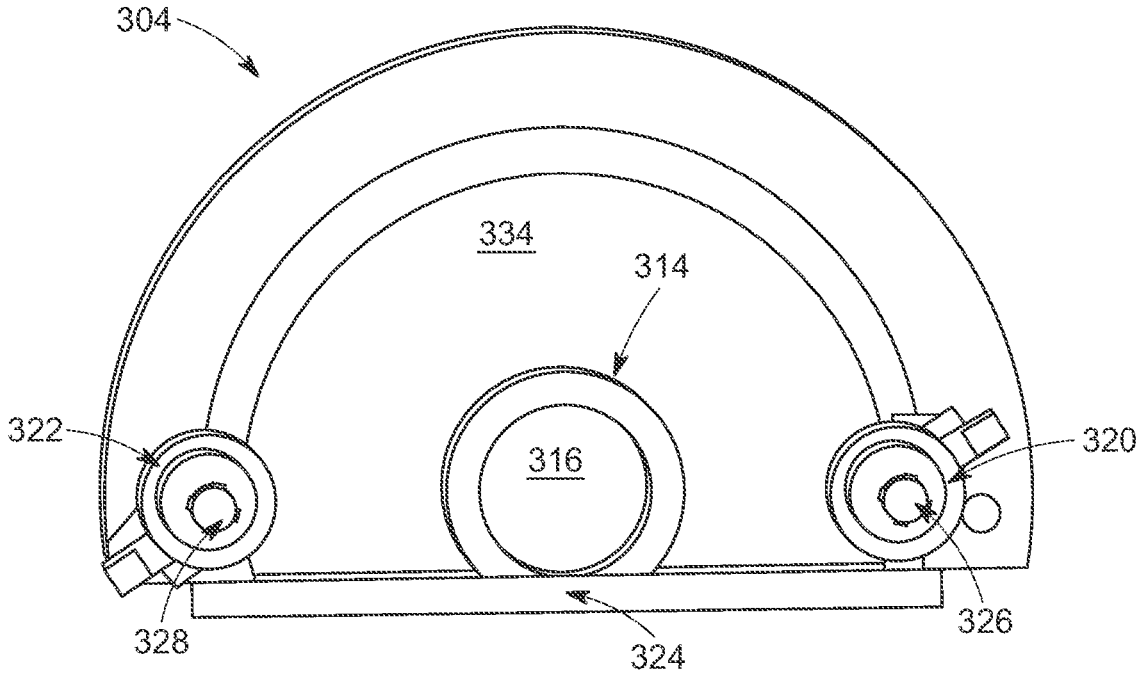
FIG. 4 is a pictorial illustration of a back side of an exemplary faceplate for the adjustment user dial assembly.
Figure 5:
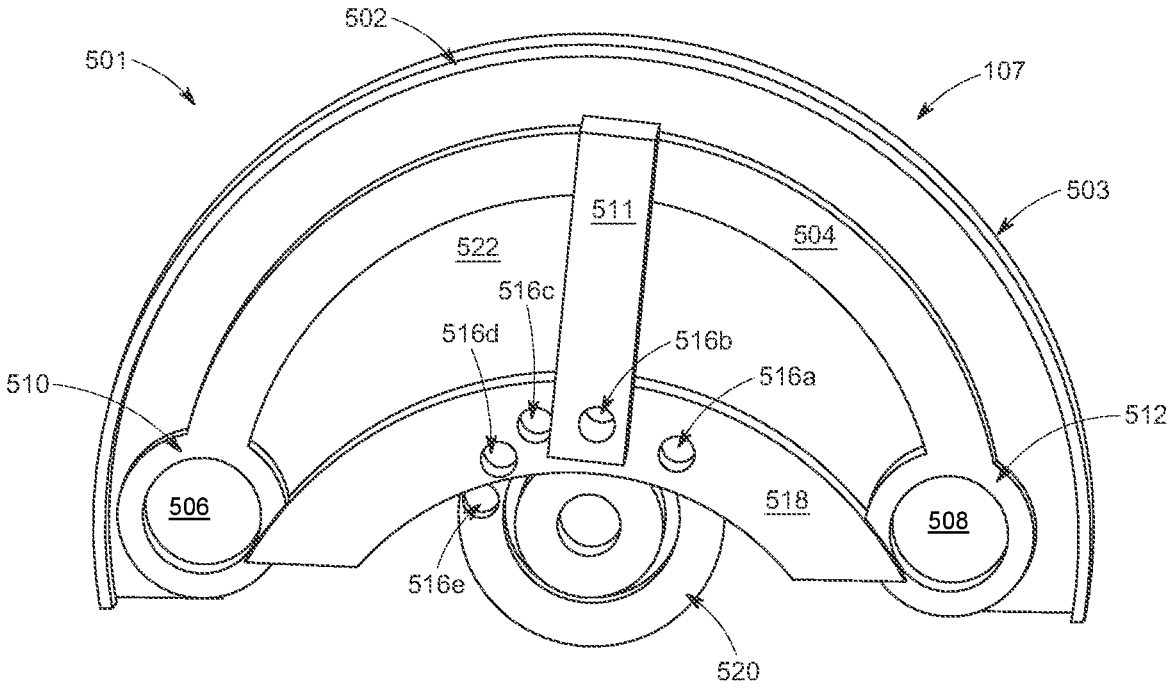
FIG. 5 is a pictorial illustration of a back side of an exemplary baseplate for the adjustment user dial assembly.

FIGS. 3-4 depict the faceplate 108 according to a non-limiting embodiment. FIG. 3 depicts an exemplary front side 302 of the faceplate 108 while FIG. 4 depicts an exemplary back side 304 of the faceplate 108. In a non-limiting embodiment, the faceplate 108 has a body 306 that has an outer peripheral edge 307 that is arch shaped and is joined with a bottom surface 324 that is straight and level. The outer peripheral edge 307 of the body 306 is extended away from a recessed inner level 309. The outer peripheral edge 307 forms a lip or ridge that extends above a recessed surface 310 between the outer edge 307 and the recessed inner level 309. A cylindrical-shaped element 314 joins with the bottom surface 324. The cylindrical shaped element 314 defines a central opening 316. An arch shaped gap 334 extends between the inner edge of the recessed inner level 309 and the top of the bottom surface 324 and the cylindrical shaped element 314. Notably, marked on the faceplate 108 (e.g., on the front surface of the recessed inner level 309) there may be a number of size markings, such as 109*a*, 109*b*, 109*c*, 109*d*, and 109*e*. As noted above, the symbol "0" associated with 109*a* may indicate that this size may be used to fully retract the adjustable hanger 100. Further, size indicator 109*b* may be associated with size small and symbol "S", size indicator 109*c* may be associated with size medium and symbol "M", size indicator 109*d* may be associated with a size large and the symbol "L", and size indicator 109*e* may be associated with a size extra large and the symbol "XL." Accordingly, one or more alphanumeric symbols 109*a*-109*e* on the faceplate 108 helps to indicate a size that the adjustment user dial 110 can be turned to. Additionally, FIG. 4 shows that at a lower end of the back side 304 of the faceplate 108, the faceplate 108 may include a first post 322 and a second post 320 having a first protruding post element 326 and a second protruding post element 328, respectively.

Turning to FIG. 5, a back side 501 of the baseplate 107 is depicted according to an exemplary embodiment. The baseplate 107 may have a generally arch shaped body 502 that corresponds and matches the general arch shaped body 306 of the faceplate 108.

The baseplate 107 may include an outer ridge 503 that extends around the peripheral edge of the body 502 of the baseplate 107. There may be an inner level 504 that connects via a central member 511 to a lower arch shaped element 518. On the lower arch shaped element 518, there may be at least a same number of pre-designated peg holes 516*a*-516*e* that corresponds to the same number of size indicators 109*a*-109*e* shown on the faceplate 108. Notably in a non-limiting embodiment, the position of size indicator 109*a* on the faceplate 108 may correspond with the pre-designated hole 516*a* on the baseplate 107. Similarly, the position of size indicator 109*b* on the faceplate 108 may correspond with the pre-designated hole 516*b* on the baseplate 107, the position of size indicator 109*c* on the faceplate 108 may correspond with the pre-designated hole 516*c* on the baseplate 107, the position of the size indicator 109*d* on the faceplate 108 may correspond with the pre-designated hole 516*d* on the baseplate 107, and the position of the size indicator 109*e* on the faceplate 108 may correspond with the pre-designated hole 516*e* on the baseplate 107. Shifting the adjustment user dial 110 and the peg 604 of the adjustment user dial 110 to the requisite hole 516*a*-516*e* may cause the extending or retracting of connected moveable arms 112 and 114 and their associated connecting members 126.

There may be a gap 522 between the inner level 504 and the lower arch shaped element 518. Further, there may be a first cylindrical shaped element 510 defining a central opening 506 on a left side of the baseplate 107 and a second cylindrical shaped element 512 defining a central opening 508 on a right side of the baseplate 107. A circular element 520 may also extend down away from a bottom surface of the central member 511 and away from the pre-designated holes 516*a*-516*e*.

Notably, the first protruding post element 326 and the second protruding post element 328 on the underside 304 of the baseplate 108 are configured to insertably fit within openings of a number of components of the adjustment user dial assembly 106, as shown in FIGS. 2A-2C, and further described later, including joining with the bottom openings 506 and 508 of the baseplate 107.

Figure 7:
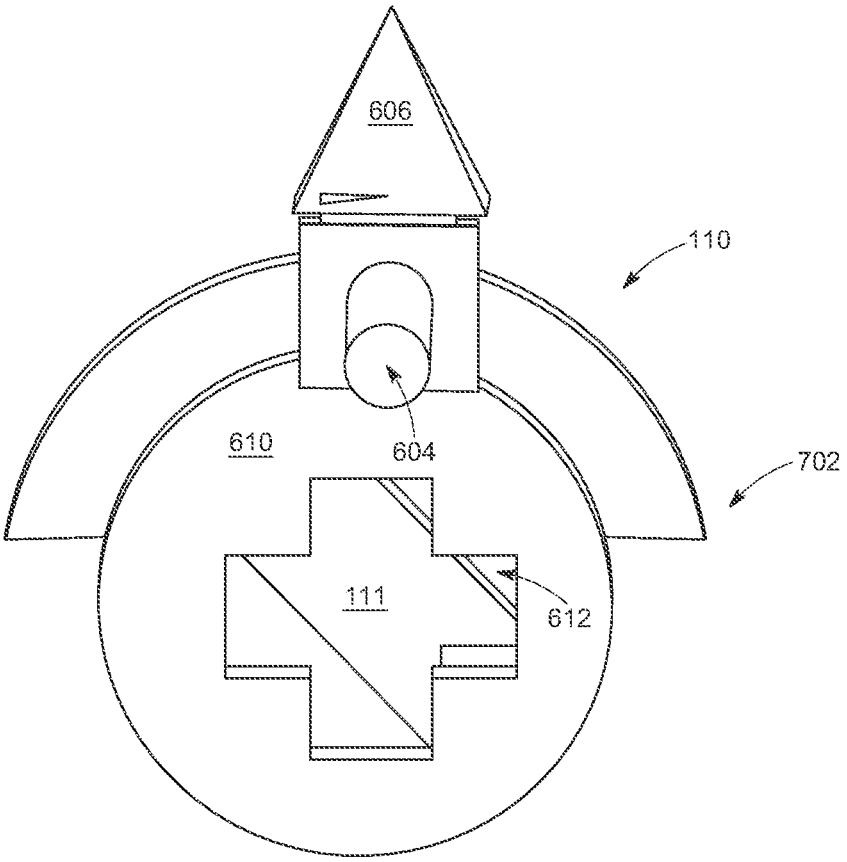
FIG. 7 is a pictorial illustration of a bottom side of an exemplary adjustment user dial.

FIG. 6 depicts a top side 602 of the adjustment user dial 110 and FIG. 7 depicts the bottom side 702 of the adjustment user dial 110 according to a non-limiting embodiment. The adjustment user dial 110 may be used as a knob that the user can manually turn in a clockwise or counterclockwise direction to adjust the width W1 of the first moveable arm 112 and the width W2 of the second moveable arm 114, respectively, and to either lengthen or shorten the moveable arms 112 and 114. In a non-limiting embodiment, the adjustment user dial 110 includes a handle 111 that protrudes upwardly from a generally circular platform 610. In a non-limiting embodiment, the handle 111 may be oriented between a first pillar 613*a* and the second pillar 613*b* that raise the handle 111 up above the surface of the platform 610. There may be a central opening 612 formed in the platform 610 beneath the handle 111. The central opening 612 can be shaped in the form of a cross in one or more non-limiting embodiments, although other shapes are feasible as well. A peg 604 may point downwards and extend away beneath the platform 610 and may be joined via a neck element 608 with a triangular shaped pointer element 606. FIG. 7 depicts the bottom side 702 or underside of the adjustment user dial 110 and a better view of the cross-shaped central opening 612 of the adjustment user dial 110.

Figure 8:
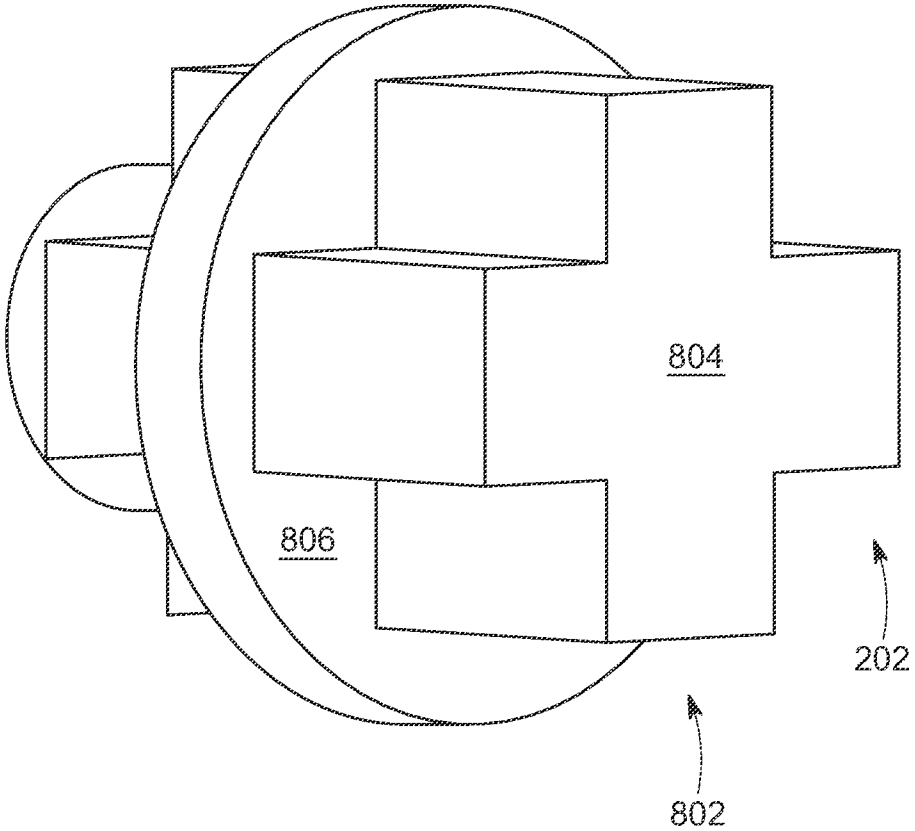
FIG. 8 is a pictorial illustration of a top side of an exemplary control pillar.
Figure 9:
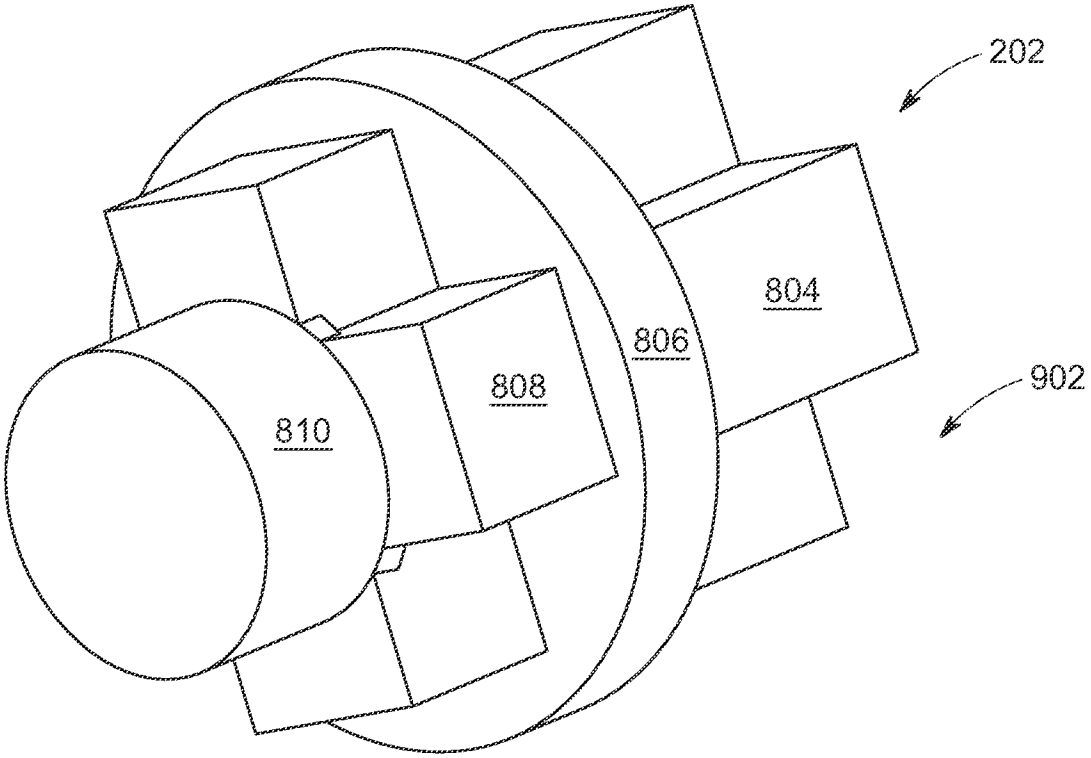
FIG. 9 is a pictorial illustration of a bottom side of an exemplary control pillar.

FIG. 8 depicts a top side 802 of the control pillar 202 according to one or more non-limiting embodiments, while the FIG. 9 depicts a bottom side 902 of the control pillar 202. The control pillar 202 is configured to be rotatably inserted into the central opening 612 of the platform 610 of the adjustment user dial 110. The control pillar 202 includes a top element 804 that is meant to be rotatably inserted into the central opening 612 of the platform of the adjustment user dial 110. The top element 804 may be attached to a central ring 806. Beneath the central ring 806 may be a bottom element 808 as shown in FIG. 9. The top element 804 and the bottom element 808 may be cross shaped in one or more non-limiting embodiments. In one or more non-limiting embodiments, there may be a cylindrical shaped element 810 attached to the bottom element 808 as well although it is not necessary and may also be omitted. In a non-limiting embodiment, the top shaped element 804 is meant to be inserted and fits into the central opening 612 of the adjustment user dial 110 while the bottom element 808 and the cylindrical element 810 may be inserted into the corresponding cylindrical opening 1004 of the control link 113 and the additional cylindrical element 810 may be small enough to also fit through the opening 1104 of the control link 113.

Turning to FIG. 10, FIG. 10 depicts a view of the control link 113. There may be one control link 113 utilized or housed in the adjustment user dial assembly 106. The control link 113 as shown in FIG. 10 may have a body in form of an elongated member 1002 that includes a central opening 1004 that is cross shaped to match the cross-shaped bottom element 808 of the control pillar 202, which will be inserted into the opening 1004 of the control link 113 that is generally centrally located. Adjacent to the opening 1004 of the control link 113 may be a peg hole 1006. The peg hole 1006 is configured and sized to receive the peg 604, as shown in FIG. 6 of the adjustment user dial 110. On each end of the control link 113 may be a first end 1008 and a second end 1010 that corresponds in shape and appearance to the first end 1108*a* and the second end 1108*b* of the connecting link 126. There may be a central opening 1009 extending through the first end piece 1008 and a central opening 1011 through the second end 1010 of the control link 113. In a non-limiting embodiment, the first end piece 1008 and the second end piece 1010 may be cylindrically shaped.

It is noted that the cross-shape of the opening 612 of the adjustment user dial 110, the cross-shape of the top element 804 and the cross-shape 808 of the control pillar 202, and the cross shape of the opening 1004 of the control link 113 may be varied to have other shapes including circular/cylindrical shape in one or more non-limiting embodiments. The cross-section may be the same among the varying elements and openings.

Turning back to FIGS. 2A-2C, FIGS. 2A-2C depict pictorial illustrations of the assembled components of the adjustment user dial assembly 106. The first protruding post 320 and protruding post element 326 of the adjustment user dial 110 is configured to be inserted within the opening 1009 of the control link 113 and the second protruding post 322 and protruding post element 328 of the adjustment user dial 110 are configured to be inserted within the opening 1011 of the control link 113. The bottom element 808 and/or cylindrical element 810 of the control pillar 202 may be inserted into the central opening 1004 of the control link, and the peg 604 of the adjustment user dial 110 may be inserted into the peg opening 1006 of the control link 113. The handle 111 of the adjustment user dial 110 is configured to be inserted into the underside of the platform 610 of the adjustment user dial 110 and into the central opening 612 of the adjustment user dial 110. In this manner, the adjustment user dial 110 is coupled to and connected to the underside of the faceplate 108 when the handle 111 of the adjustment user dial 110 is inserted into the central opening 612 of the adjustment user dial 110.

As shown in FIG. 1A, the first post 320 on the underside of the left side of the faceplate 108 may be inserted through the opening 1009 of the control link 113 and into the opening 506 of the back plate 107. Additionally, the second post 322 on the underside of the right side of the faceplate 108 may be inserted through the opening 1011 on the corresponding side of the control link 113. A cap 210*a*, as shown in FIG. 1A, may then be inserted on the underside of the first cylindrical element 510 formed in the baseplate 107 to hold the post 326 in place as attached to the faceplate 108 and to the control link 113 and to the baseplate 107. Similarly, a cap 210*b*, as shown in FIGS. 1A and 1*n* FIG. 1B, may then be inserted on the underside of the first cylindrical element 512 formed in the baseplate 107 to hold the post 328 in place as attached to the faceplate 108 and to the control link 113 and to the baseplate 107. A first end 1108*a* of the connecting link 116*d* may be attached to an underside of the cap 210*a* in order to create a rotatable link to one of the connecting members 116*d* of the first moveable arm 112 (e.g., at point 124 as shown in FIG. 1A). Similarly, a first end 1108*a* of the connecting link 118*d* may be attached to an underside of the cap 210*b* in order to create a rotatable link to one of the connecting members 118*d* of the second moveable arm 112 (e.g., at point 126 as shown in FIG. 1A). Notably, the control pillar 202 translates the rotational motion of the adjustment user dial 110 to the control link 113 which then translates to the connected members 116*a* and 118*a* of the first moveable arm 112, and the second moveable arm 114 connected to the control link 113. Further, that rotational motion is also translated to the remaining connecting members 116*b*-116*f* and 118*b*-118*f* of the first and second arm 112, 114 because the faceplate 108 and the baseplate 107 rotate in a same direction as the rotational movement (either clockwise or counter clockwise) of the adjustment user dial 110 and the adjustment user dial assembly 106 by virtue of the connection of the connecting link 116*d* to the baseplate 107 and the connection of the connecting link 118*d* to the baseplate 107. Accordingly, the rotational movement of the adjustment user dial assembly 106 and its components transfers the lateral movement of the hingedly connecting members 116*a*-116*f* and hingedly connecting members 118*a*-118*f* of the first and second moveable arms 112, 114.

FIG. 1C depicts the assembled components of the adjustment user dial assembly 102. Notably, there is a gap 220 that exists between the faceplate 108 and the baseplate 107 and the other housed components as assembled as shown in FIG. 1C and also shown in FIG. 14. Notably, the control link 113 connects at point 120 to one end of connecting link 116*a* of the first moveable arm 112 and at the other end to connecting link 118*a* of the second moveable arm 114 via one or more male/female caps or other fasteners, and the control link 113 is able to rotate up or down within the gap 220 between the faceplate 108 and the baseplate 107 depending on the direction of rotation of the handle 111 of the adjustment user dial 110.

To select the designated size 109*a*-109*e*, it is intended that the user grasps the handle 111 of the adjustment user dial 110 and pulls up so as to pull the peg 604 of the adjustment user dial 110 upwardly out of the peg hole 1006 of the control link 113 and out of one of the predetermined peg holes 516*a*-516*e* in the baseplate 107. The user can pull the peg 604 up and out and turn the adjustment user dial 110 in either a clockwise or counterclockwise direction, while guided by the size label 109*a*-109*e* to which the user wants to have the moveable arms 112-114 of the adjustable hanger 100 adjust, and then push down to insert the peg 604 into one of the peg holes 516*a*-516*e* of the baseplate 107. Accordingly, if a user wants the adjustable hanger 100 to adjustably extend to fit the small size associated with size indicator 109*b* on the faceplate 108, then the user may rotate the adjustment user dial 110 towards size indicator 109*b* such that the peg 604 may be directed and inserted to peg hole 516*b* in the baseplate 107 (as well as through the peg hole 1006 of the control link 113), and then the connecting links 116*a*-116*f* of the first moveable arm 112 and the connecting links 118*a*-118*f* of the second moveable arm 114 may extend in that direction.

Notably, the hanger hook piece 102 is attached to the faceplate 108 at connection 132 as shown in FIGS. 1A and 1*n* FIG. 1B. The connection 132 may be formed from the male clamp element 206 hooking over the outer ridge portion 307 of the faceplate 108 and the female clamp element 208 coupled to the outer ridge portion 503 of the baseplate 107. The male clamp 206 and the female clamp 208 may hook into each other to keep the hanger hook portion 101 static and fixed on the faceplate 108 and baseplate 107.

Figure 12:
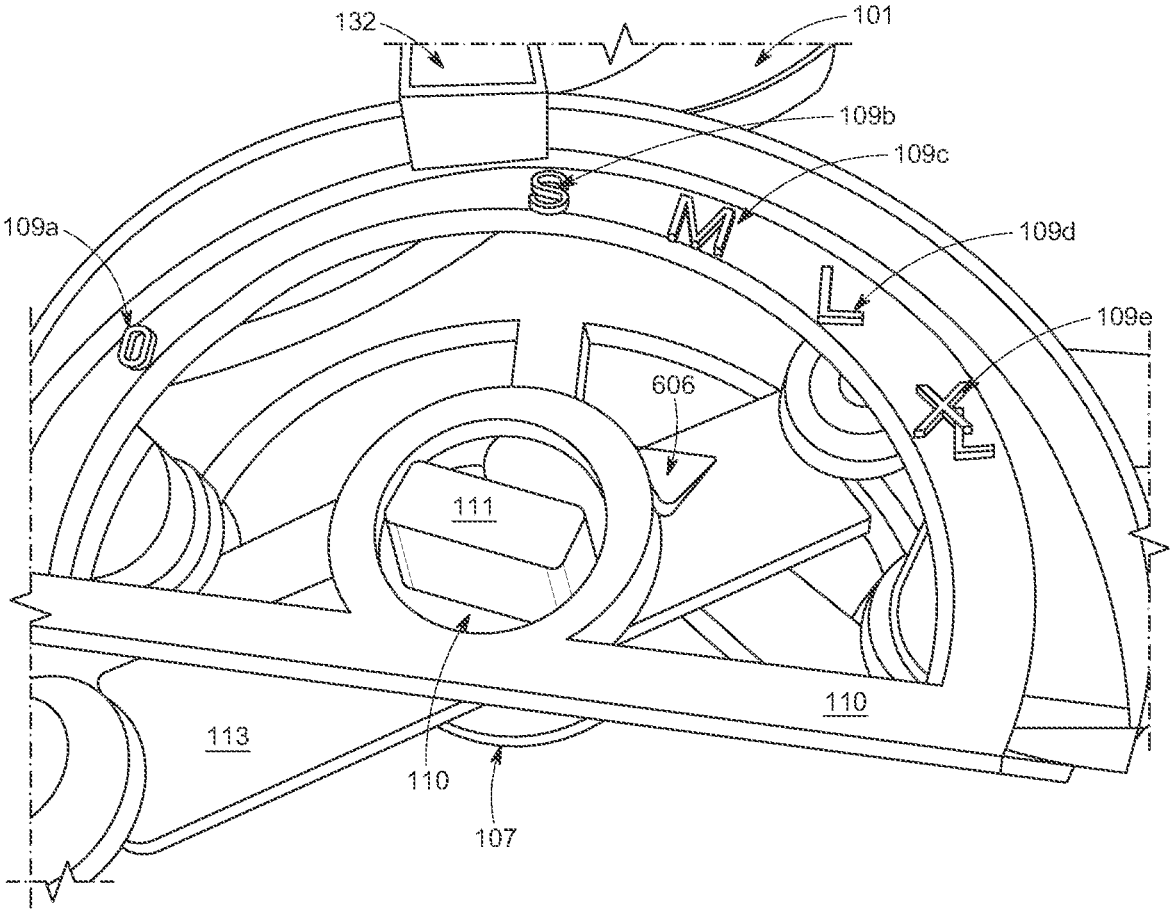
FIG. 12 is a pictorial illustration of a close up view of the assembled adjuster user dial assembly and the hook hanger.
Figure 13:
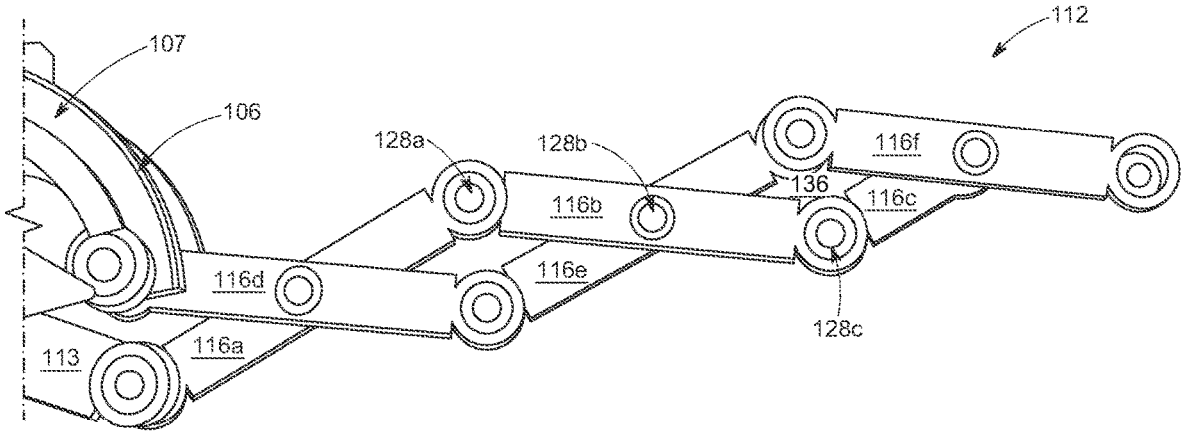
FIG. 13 is a pictorial illustration of a moveable arm of the adjustable hanger.
Figure 14:
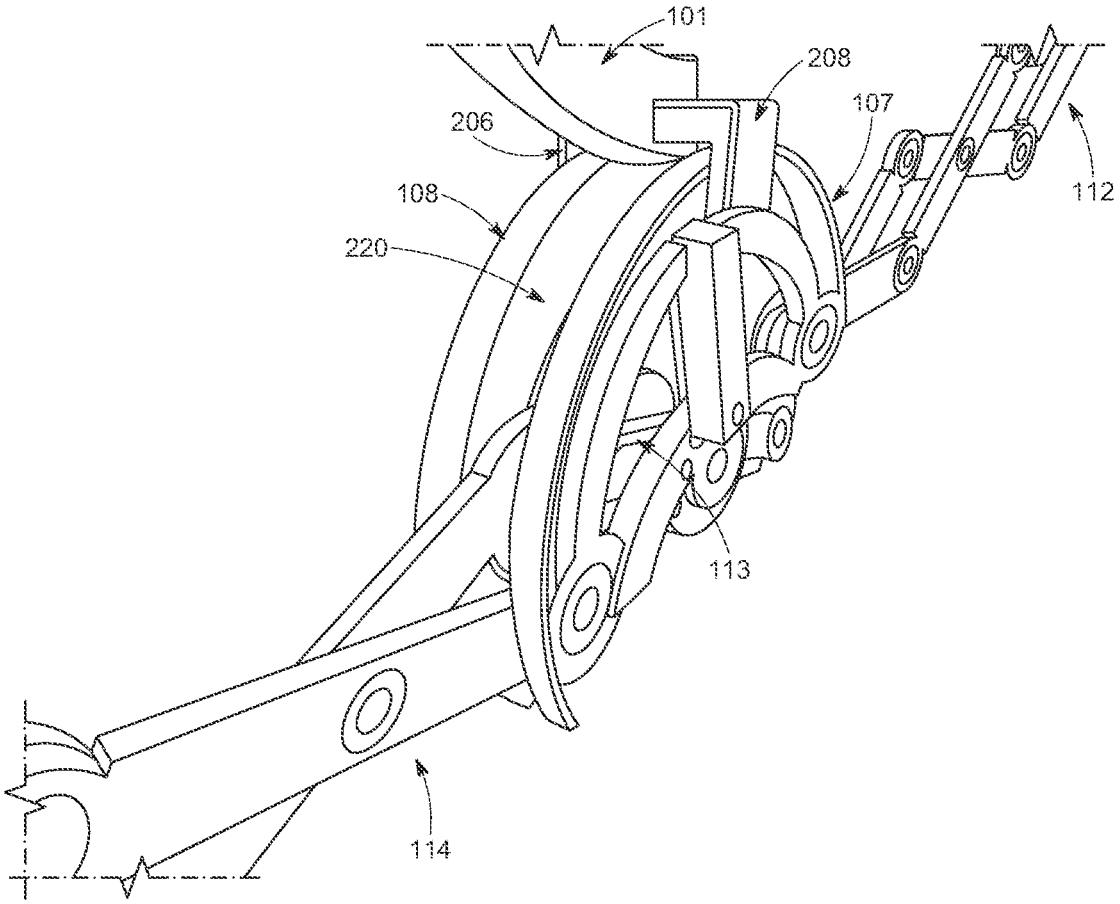
FIG. 14 is a pictorial illustration of side perspective view of the assembled adjustable hanger.

FIG. 12 shows a close up view of the faceplate 108 and the respective sizes including 109*a* (for full retraction/shortening of the first moveable arm 112 and the second moveable arm 114), as well as 109*b*, 109*c*, 109*d*, and 109*e*. Notably, the adjustment user dial 110 and the control pillar 202 are fixedly inserted within the central opening 1004 of the control link 113, such that the control link 113 acts as a fulcrum about which the connected adjustment user dial 110 and the control pillar 202 can pivot in either a clockwise or counter clockwise direction for the pointer 606 of the adjustment user dial 110, as shown in FIG. 12, to point to the desired size indicator 109*a*-109*e*. The connecting links 116*a*-116*e* of the first moveable arm 112 and the connecting links 118*a*-118*f* of the second moveable arm 114 can shift up and down as connected to the control link 113 and at each lower ends 124, 126 of the adjustment user assembly 106 in a scissor like back and forth motion in the form of scissor linkages, as shown in FIG. 13.

Advantageously, the addition of size tabs 104*a*-104*d* on hook 101 and a slidably attached size highlighter 102 on hook 101 allows for a user to easily identify the sizing adjustment of adjustable hanger 100 and the size of the corresponding article of clothing being hung. This removes the need to check the clothing article itself. Furthermore, adjustable hanger 100 has the additional benefit of being able to fully retract and provide a user with the ability to easily store or transport the hanger (e.g., when 109*a* on faceplate 108 is selected). Traditional hangers are static in size and are not easily stored. This is especially true due to the odd shape of hangers. Adjustable hanger 100 retracts, bringing moveable arm 112 and moveable arm 114 to a relatively negligible storage area, or can fully extend over a range of sizes from small, medium, large, to x-large and beyond.

An additional aspect of the invention includes adjustable hanger 100 having first moveable arm 112 and second moveable arm 114 comprising internally nesting, expandable and retractable linkages. Furthermore, moveable arm 114 and moveable arm 114 adjust to set intervals and may be lockingly secured at such intervals.

Accordingly, the present description provides for various embodiments for an adjustable hanger 100. There are many uses and advantages offered for adjustable hanger 100 as described above in one or more non-limiting embodiments in the present description.

In this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined acts, the defined acts can be carried out in any order or simultaneously (except where the context excludes that possibility), and the method can include one or more other acts which are carried out before any of the defined acts, between two of the defined acts, or after all the defined acts (except where the context excludes that possibility).

"Exemplary" may be used herein to mean "serving as an example, instance, or illustration." Any aspect described in this document as "exemplary" may not be necessarily to be construed as preferred or advantageous over other aspects.

Throughout the drawings, like reference characters are used to designate like elements. As used herein, the term "coupled" or "coupling" may indicate a connection. The connection may be a direct or an indirect (e.g., mechanical) connection between one or more items. Further, the term "set" as used herein may denote one or more of any items, so a "set of items" may indicate the presence of only one item or may indicate more items. Thus, the term "set" may be equivalent to "one or more" as used herein.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. An adjustable hanger comprising:

a hanger hook;

an adjustment user dial assembly, wherein the hanger hook is coupled to the adjustment user dial assembly, wherein the adjustment user dial assembly comprises:

a faceplate having a body with a curved member connected to a bottom edge with a gap between the bottom edge and the curved member, and a faceplate central opening formed connected to the bottom edge, and further comprising a first post and a second post extending from a bottom surface of the faceplate;

an adjustment user dial having a handle sticking up over a top surface of a platform of the adjustment user dial and a peg protruding from a bottom surface of the platform of the adjustment user dial, wherein the bottom surface of the adjustment user dial further comprises a first opening, and wherein a pointer is coupled to a front side of the platform of the adjustment user dial;

a control pillar comprising a top surface having a top element and a bottom surface having a bottom element, wherein the top element has a cross-sectional shape that fits into the first opening of the adjustment user dial;

a control link, wherein the control link is an elongated member having a hole configured to receive the peg of the adjustment user dial, wherein the control link further comprises a central opening, wherein the hole is positioned next to the central opening, wherein the bottom element of the control pillar fits within the central opening of the control link;

a baseplate, wherein the adjustment user dial, the control pillar, and the control link are housed between the faceplate and the baseplate of the adjustment dial assembly, wherein the baseplate has a generally arch-shaped body and further comprises two post openings on each end of the base plate that are adapted to receive the first post and the second post of the faceplate, wherein the baseplate further comprises a platform formed between the two post openings of the baseplate, wherein the platform comprises a set of peg holes configured to receive the peg of the adjustment user dial, wherein the set of peg holes correspond to pre-determined sizes labeled on a front surface of the faceplate, wherein moving the handle of the adjustment user dial causes the peg to rotate to one of the peg holes of the set of peg holes;

a first moveable arm attached to the adjustment user dial assembly, the first moveable arm comprising a first set of connecting members that are interconnected, linkable, and movable about pivot points built into each connecting member of the first set of connecting members, wherein the adjustment user dial assembly is adapted to cause the coordinated expansion and retraction of the first moveable arm to a left direction of the adjustment user dial assembly; and a second moveable arm attached to the adjustment user dial assembly, the second moveable arm comprising a second set of connecting members that are interconnected, linkable, and movable about pivot points built into each connecting member of the second set of connecting members, wherein the adjustment user dial assembly is adapted to cause the coordinated expansion and retraction of the second moveable arm to a right direction of the adjustment user dial assembly;

wherein the first moveable arm and the second moveable arm are adapted to retract and expand over a range of pre-determined widths that correspond to the pre-determined sizes, wherein the handle of the adjustment user dial is adapted to be lifted and rotated in a clockwise or counter clock wise direction to position the peg of the adjustment user dial in a peg hole of the set of peg holes that corresponds to a desired size of the pre-determined sizes, thereby causing the first moveable arm and the second moveable arm to engage in the coordinated expansion or retraction of the first moveable arm and the second moveable arm to a pre-determined width that corresponds to the desired size.

2. The adjustable hanger of claim 1, wherein the hanger hook is connected to the adjustment user dial assembly.

3. The adjustable hanger of claim 1, wherein the first and second moveable arms comprises scissor linkages between the first set of connecting members and between the second set of connecting members.

4. The adjustable hanger of claim 3, wherein the scissor linkages comprise more than two linked members.

5. The adjustable hanger of claim 1, wherein one or more connecting members comprise an elongated member having a central opening centrally located for each connecting member and a first opening at a first end of the elongated member and a second opening at a second end of the elongated member, wherein the central opening, the first opening, and the second opening are the pivot points.

6. The adjustable hanger of claim 1, wherein one or more connecting members are half-links and comprise only two pivot points, including a central opening and an end opening.

7. The adjustable hanger of claim 1, wherein each connecting rod of the first set of connecting rods and each connecting rod of the second set of connecting rods have a hinged connection that rotates according to a direction of rotation of the adjustment user dial of the adjustment user dial assembly to extend and retract.

8. The adjustable hanger of claim 1, wherein the hanger hook is oriented in a vertical direction and the first moveable arm and the second moveable arm are oriented in a horizontal direction, and wherein the adjustment user dial assembly is rotatable according to a placement of the peg of the adjustment user dial in the set of peg holes.

9. The adjustable hanger of claim 1, further comprising a set of sizing indicators located on the hook.

10. The adjustable hanger of claim 9, further comprising a size highlighter slidably attaching to the hook and indicating a selected size.

11. The adjustable hanger of claim 1, wherein the set of pre-determined sizes correspond to small, medium, large, and extra-large.

12. The adjustable hanger of claim 1, further comprising a label indicating a number or letter correlating to full retraction of the first moveable arm and the second moveable arm, wherein the label correlates to a storage or transport position for the adjustable clothes hanger for reduced space usage of the adjustable hanger.

13. The adjustable hanger of claim 1, wherein a first end of the control link is coupled to a first end of a starting connecting member for the first moveable arm and a second end of the control link is coupled to a first end of a starting connecting member for the second moveable arm, wherein rotation of the adjustment user dial causes the control link to cause expansion in a lateral direction of the starting connecting member for the first moveable arm and for the starting connecting member for the second moveable arm.

14. The adjustable hanger of claim 13, wherein a second starting connecting member for the first moveable arm and the second starting connecting member for the second moveable arm is coupled to the adjustment user dial assembly, wherein rotational movement of the adjustment user dial in the adjustment user dial assembly causes corresponding rotational movement of the second starting connecting member for the first moveable arm and the second starting connecting member.

15. The adjustable hanger of claim of claim 14, wherein the first post of the faceplate extends through a first opening of the second starting connecting member for the first moveable arm and the second post of the faceplate extends through a first opening of the second starting connecting member for the second moveable arm.

16. The adjustable hanger of claim 1, wherein the pointer on the adjustment user dial is rotatable to point to a size of the pre-determined sizes labeled on the front surface of the faceplate.

17. The adjustable hanger of claim 1, wherein the first opening of the adjustment user dial, the top element and the bottom element of the central link, and the central opening of the control link are cross-shaped.

18. The adjustable hanger of claim 1, wherein a gap exists between the faceplate and the baseplate and internal components when the adjustment user dial assembly is assembled.

19. The adjustable hanger of claim 1, wherein the hanger hook is coupled by a male clamp and a female clamp coupled to the faceplate and to the baseplate.

20. The adjustable hanger of claim 19, wherein the male clamp fits over a raised outer ridge of the front surface of the faceplate and wherein the female clamp fits over a raised outer ridge of a bottom surface of the baseplate, wherein the male clamp fits into the female clamp.

* * * * *